US005591006A

United States Patent [19]

DeMeo et al.

[11] Patent Number: 5,591,006

[45] Date of Patent: Jan. 7, 1997

[54] DECORATIVE COVER FOR CEILING FAN BLADE

[76] Inventors: Paul J. DeMeo, 1828 Edgewater Dr., Sarasota, Fla. 34234-8447; Brian J. Billert, 3206 7th Ave. West, Brandenton, Fla. 34205

[21] Appl. No.: 562,527

[22] Filed: Nov. 27, 1995

[51] Int. Cl.[6] ..... F04D 29/70

[52] U.S. Cl. ..... 416/62; 416/5; 416/146 R

[58] Field of Search ..... 416/62, 5, 146 R; D23/386, 411, 412

[56] References Cited

U.S. PATENT DOCUMENTS

| | | | |
|---|---|---|---|
| D. 341,881 | 11/1993 | Smith et al. . | |
| 2,288,592 | 7/1942 | Mirhige | 416/62 |
| 4,676,721 | 5/1987 | Hardee | 416/5 |
| 4,832,572 | 5/1989 | Prucha et al. . | |
| 5,273,399 | 12/1993 | Ojeda | 416/146 R |
| 5,281,093 | 1/1994 | Sedlak et al. . | |
| 5,516,264 | 5/1996 | Anetrini | 416/146 R |

FOREIGN PATENT DOCUMENTS

| | | | |
|---|---|---|---|
| 0196337 | 10/1986 | European Pat. Off. | 416/146 R |

*Primary Examiner*—Edward K. Look
*Assistant Examiner*—Mark Sgantzos
*Attorney, Agent, or Firm*—Charles J. Prescott

[57] ABSTRACT

A removable, washable decorative cover for each thin, flat fan blade of a paddle-type ceiling fan. The decorative cover includes a main sleeve of uninterrupted tubular shape, each end of which is open, and formed of highly elastic and expandable decorative fabric, preferably SPANDEX. The main sleeve is of sufficient elastic strength and sized substantially smaller in width than the width of the fan blade whereby, when mounted over a preselected main portion in length of the fan blade, the gripping action of the elastically stretched fabric conformingly against the surface of the main portion of the fan blade is sufficient to prevent movement therebetween when the ceiling fan is in operation. The cover may also include an end sleeve formed of the same elastic fabric and transverse width, one end of which is open, the other end of which is closed. The end sleeve conformingly fits over the distal end of the fan blade in either spaced, abutting or overlapping orientation on the distal portion of the fan blade with respect to one open end of the main sleeve. The end sleeve is likewise of sufficient elastic strength, when stretched to cover the distal portion of the fan blade, to remain stationary on the distal end of the fan blade during ceiling fan operation.

5 Claims, 3 Drawing Sheets

DECORATIVE COVER FOR CEILING FAN BLADE

SCOPE OF INVENTION

This invention relates generally to decorative ceiling fan blades of a paddle-type ceiling fan, and more particularly to a washable, elastic covering for each such fan blade.

PRIOR ART

Ceiling fans having a plurality of generally flat elongated fan blades held in radially extending symmetric orientation with respect to a central rotational output shaft of a motor attachable to the ceiling are well known. These fan blades will circulate air either downwardly to the center of the room or upwardly and along the ceiling, depending on the rotational direction of the motor.

Although some such fan blades are decoratively designed, typically they are fabricated of thin, flat wooden members of a somewhat unornamental nature. During months and even years of intermittent or virtually continuous operation of the ceiling fan, the fan blades are also subject to collecting dust and other airborne debris, especially on the upwardly facing surfaces of the blade. Because the ceiling fans are typically positioned just below a ceiling surface, access for cleaning is difficult at best. Elongated dusting members specifically designed for ceiling fan blades are available to assist in this task.

Removable fan blade covers have been described in two previous U.S. Pat. Nos. 4,832,572 and 5,281,093 co-invented by Prucha and Sedlak. These patents teach the use of single piece fan blade covers which permit the safe and easy cleaning by removal of the covers when required. These covers also enhance the overall appearance of the fan blade by the selection of decorative colors and designs. However, both of these inventions include attaching structure at the open proximal end thereof for tightly conforming to the narrowed proximal end of each fan blade, the distal end of the fan blade being covered by a closed end of each cover which adds additional cost and replacement difficulty.

The present invention utilizes a highly elastically expandable fabric such as SPANDEX to provide a tubular configured main sleeve which is elastically positionable over a preselected length of the fan blade, the highly elastic nature of the SPANDEX, in combination with the substantially smaller width of the main sleeve in its relaxed configuration cooperatively acting to maintain the position of the main sleeve on the fan blade during ceiling fan operation. An end sleeve is also provided which may be of a decoratively similar or dissimilar elastic fabric so that the distal portion of each fan blade is also decoratively covered.

BRIEF SUMMARY OF THE INVENTION

This invention is directed to a removable washable decorative cover for each thin, flat fan blade, of a paddle-type ceiling fan. The decorative cover includes a main sleeve of uninterrupted tubular shape, each end of which is open, and formed of highly elastic and expandable decorative fabric, preferably SPANDEX. The main sleeve is of sufficient elastic strength and sized substantially smaller in width than the width of the fan blade whereby, when mounted over a preselected main portion in length of the fan blade, the gripping action of the elastically stretched fabric conformingly against the surface of the main portion of the fan blade is sufficient to prevent movement therebetween when the ceiling fan is in operation. The cover may also include an end sleeve formed of the same elastic fabric and transverse width, one end of which is open, the other end of which is closed. The end sleeve conformingly fits over the distal end of the fan blade in either spaced, abutting or overlapping orientation on the distal portion of the fan blade with respect to one open end of the main sleeve. The end sleeve is likewise of sufficient elastic strength, when stretched to cover the distal portion of the fan blade, to remain stationary on the distal end of the fan blade during ceiling fan operation.

It is therefore an object of this invention to provide a unique removable, washable, decorative cover for each thin, flat blade of a ceiling fan.

It is yet another object of this invention to provide a serviceable cover for each fan blade of a ceiling fan which is economical to manufacture and easily installable and removable without the need for any additional attaching structure therewith.

It is yet another object of this invention to provide a two-part, washable decorative cover for each fan blade of a ceiling fan, a main portion of the cover snugly conforming to the main portion of the fan blade, while an end sleeve of the cover elastically conforms to and covers a distal end of the fan blade in either spaced, matching, or overlapping relationship with the main sleeve.

In accordance with these and other objects which will become apparent hereinafter, the instant invention will now be described with reference to the accompanying drawings.

DETAILED DESCRIPTION OF THE INVENTION

Figure 1:
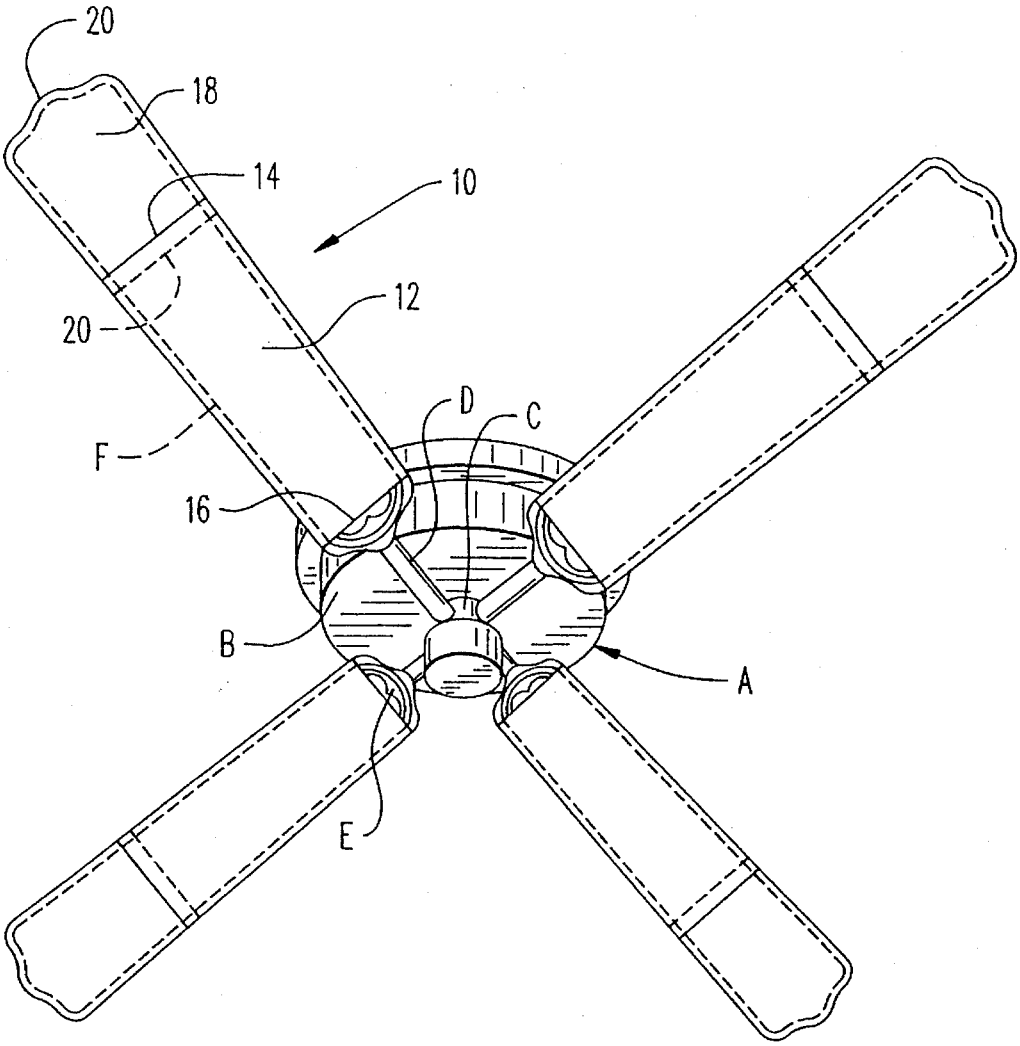
FIG. 1 is a perspective view of the preferred embodiment of the invention installed on each fan blade of a ceiling fan.
Figure 2:
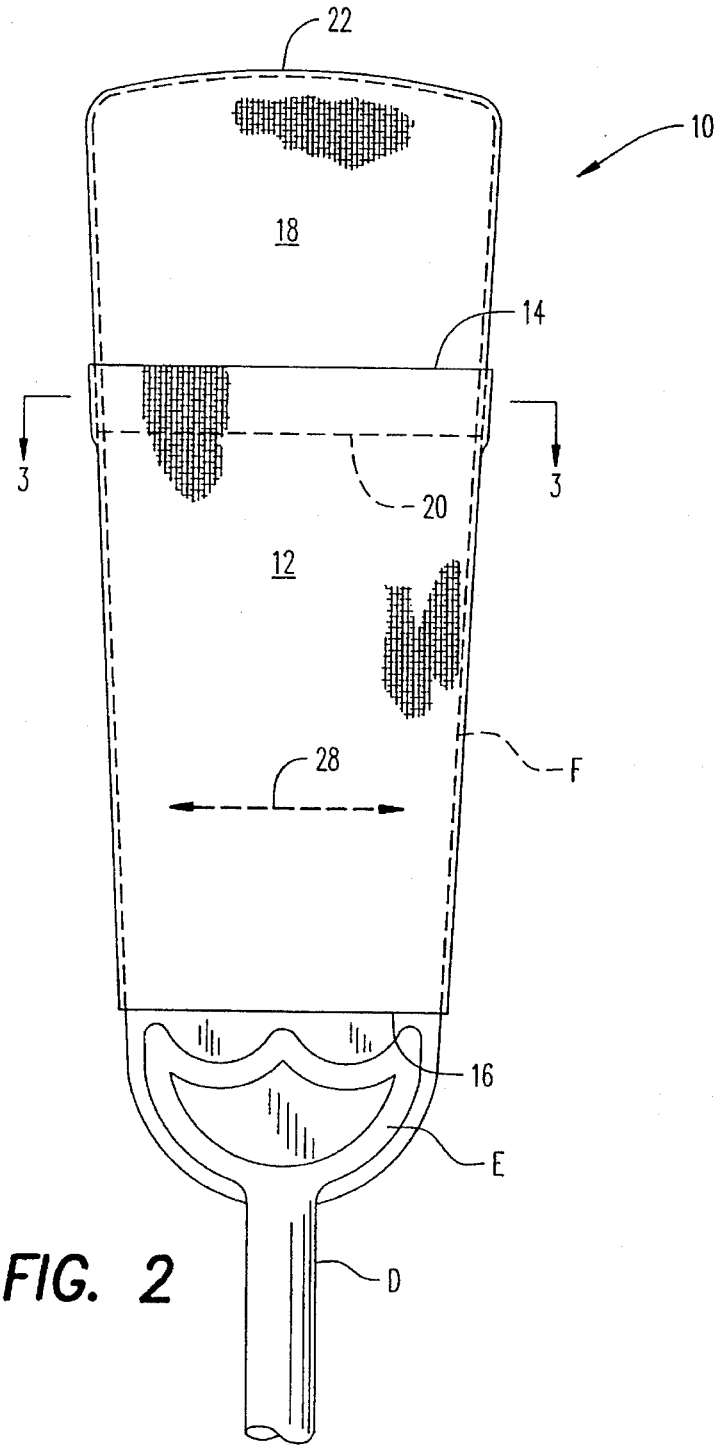
FIG. 2 is a plan view of one fan blade with the preferred embodiment of the invention of FIG. 1 installed thereon.

Referring now to the drawings, the preferred embodiment of the invention is shown generally at numeral 10 in FIGS. 1 and 2 and includes a washable, removable decorative highly elastic main sleeve 12 and a highly elastic removable, washable, decorative end sleeve 18. These main and end sleeves 12 and 18 are shown in conforming position mounted on each elongated, thin, flat fan blade F of a ceiling fan A. The ceiling fan A typically includes a housed motor B having a rotating output shaft C which drivably engages a plurality of support arms D connected to the proximal end of each fan blade at E.

Figure 3:
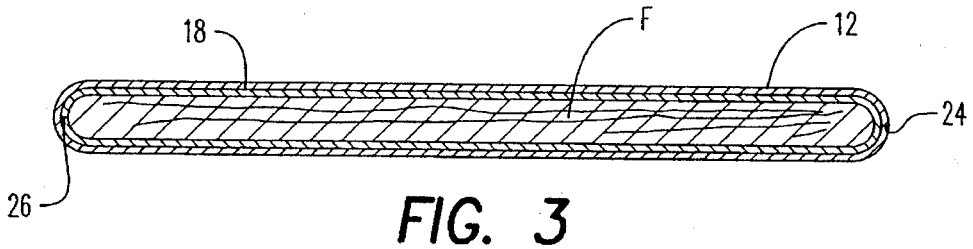
FIG. 3 is a section view in the direction of arrows 3—3 in FIG. 2.

As best seen in FIGS. 2 and 3, the main sleeve 12 is formed of highly elastic flexible fabric such as SPANDEX into a tubular configuration by stitching of a rectangular sheet along common margins at 24 and having each end thereof at 14 and 16 open. Alternately, the main sleeve 12 may be manufactured in a seamless version also referred to as a tubular one-piece construction. The overall length of the main sleeve 12 is less than the overall length of the fan blade F and the width of the main sleeve 12 in its relaxed configuration is substantially less in overall width than that of the fan blade F. Because the SPANDEX is highly elastic in the direction of arrow 28, the preferred width of the relaxed main sleeve 12 is approximately half that of the fan blade F.

When stretched in the direction of arrow 28 transversely, the main sleeve 12, then, tightly and conformingly grips against the outer surface of the fan blade F so that, in operation, the main sleeve 12 remains in the preselected position along the length of the fan blade F, being resistant to both centrifugal and air movement forces encountered during ceiling fan operation.

The end sleeve 18 is likewise formed of the same highly elastic preferably SPANDEX material stitched together along common margins 26 and having an open end 20 and a closed end 22 which elastically conforms with and covers the distal end of the fan blade F. The overall length of the end sleeve 18 is such that a distal portion of the fan blade F is covered when mounted thereon.

As with the main sleeve 12, the end sleeve 18 is sized in relaxed width to be approximately half the width of the fan blade F so that, when elastically stretched for mounting as shown in FIG. 2, neither centrifugal forces or air movement during ceiling fan operation will alter positioning therebetween.

In FIGS. 2 and 3, the open margin 14 is positioned over and conceals the open margin 20 of the end sleeve 18 for both decorativeness and a neat appearance. However, the two open margins 14 and 20 may be abutted or spaced apart as desired. Likewise, open margin 16 is shown positioned immediately adjacent the decorative fan blade engaging structure E. However, if desired, the main sleeve 12 may be repositioned or stretched in the direction of arrows 30 so as to conceal all or a portion of this decorative portion E as shown in FIG. 4.

Figure 4:
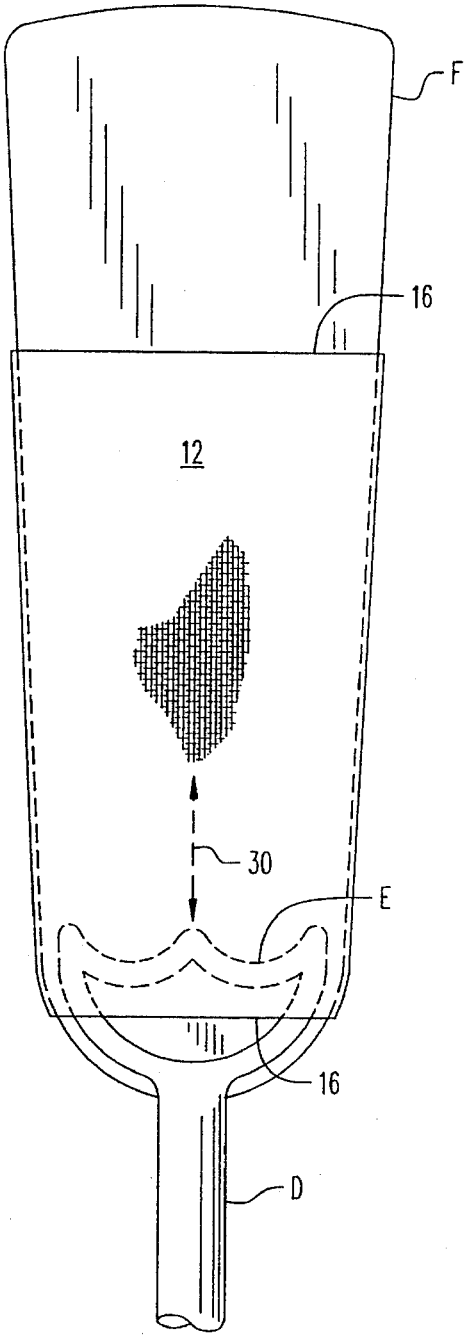
FIG. 4 is a view similar to FIG. 2 showing only the main sleeve of the invention in a different orientation along the length of the fan blade.
Figure 5:
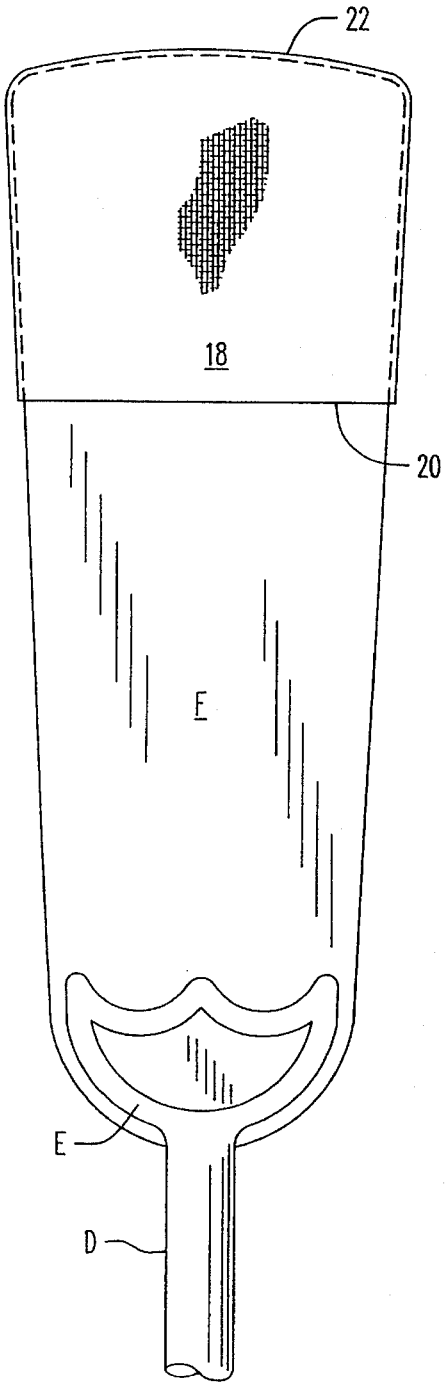
FIG. 5 is a view similar to FIG. 4 showing only the end sleeve positioned over the distal end of the fan blade.

Further, in FIG. 4, only the main sleeve 12 is shown mounted on the main portion of the fan blade F, while in FIG. 5, only the end sleeve, 18 is mounted on the distal end portion of the fan blade. The invention, in its preferred embodiment, then, offers a wide range of decorative options, the pattern of the fabric used for the main sleeve 12 and end sleeve 18 either matching or dissimilar as desired.

It should be noted that the tubular stitched structure may be replaced with seamless tubular formed SPANDEX material.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A removable, washable decorative cover for each thin, flat fan blade of a ceiling fan comprising: an elastic fabric main sleeve having generally parallel side margins and substantially open at each end thereof; said main sleeve, when in a relaxed configuration, substantially smaller in transverse width than that of the fan blade; said main sleeve elastically expandable for form fitting sliding engagement over a preselected main portion in length of the fan blade, said main sleeve being shorter in length, when mounted on the fan blade, than the length of the fan blade whereby each said main sleeve open end slides over and past a distal end of the blade and is elastically fitted transversely around the fan blade; said main sleeve, when mounted on the fan blade, elastically gripping the fan blade to maintain said main sleeve in stationary position on the fan blade when the ceiling fan is in operation.

2. A decorative cover as set forth in claim 1, further comprising: an elastic fabric end sleeve having generally parallel side margins and an open and a closed end; said end sleeve, when in a relaxed configuration, substantially smaller in transverse width than that of the fan blade; said end sleeve elastically expandable in transverse width for form fitting engagement over a distal end portion of the fan blade; said end sleeve open end positioned adjacent to one said open end of said main sleeve when mounted on the fan blade; said end sleeve expanding sufficiently in transverse width, when mounted on the distal portion of the fan blade, elastically gripping the distal portion of the fan blade to maintain said sleeve in stationary position thereon when the ceiling fan is in operation.

3. A decorative cover as set forth in claim 2, wherein said main sleeve and said end sleeve have a relaxed width in the range of about half the width of the fan blade.

4. A removable, washable decorative cover for each thin, flat fan blade of a ceiling fan comprising: an elastic fabric main sleeve having generally parallel side margins and open at each end thereof; said main sleeve, when in a relaxed configuration, substantially smaller in transverse width than that of the fan blade; said main sleeve elastically expandable in transverse width for form fitting engagement over a preselected main portion in length of the fan blade, said main sleeve being shorter in length than the length of the fan blade whereby each said main sleeve open end is elastically fitted transversely around the fan blade; said main sleeve expanding sufficiently in transverse width, when mounted on the fan blade, for elastically gripping the fan blade to maintain said main sleeve in stationary position on the fan blade when the ceiling fan is in operation; an elastic fabric end sleeve having generally parallel side margins and an open and a closed end; said end sleeve, when in a relaxed configuration, substantially smaller in transverse width than that of the fan blade; said end sleeve elastically expandable in transverse width for form fitting engagement over a distal end portion of the fan blade; said end sleeve open end positioned adjacent to one said open end of said main sleeve when mounted on the fan blade; said end sleeve, when mounted on the distal portion of the fan blade, elastically gripping the distal portion of the fan blade to maintain said sleeve in stationary position thereon when the ceiling fan is in operation.

5. A decorative cover as set forth in claim 4, wherein said main sleeve and said end sleeve have a relaxed width in the range of about half the width of the fan blade.

* * * * *